US007704016B2

(12) United States Patent
Gransaether

(10) Patent No.: US 7,704,016 B2
(45) Date of Patent: Apr. 27, 2010

(54) SUBSEA DOCKING SYSTEM FOR ELECTRONIC MODULES IN SUBSEA INSTALLATIONS

(75) Inventor: Eivind S. Gransaether, Oslo (NO)

(73) Assignee: Roxar Flow Measurement AS, Bergen (NO)

( * ) Notice: Subject to any disclaimer, the term of this patent is extended or adjusted under 35 U.S.C. 154(b) by 181 days.

(21) Appl. No.: 11/785,474

(22) Filed: Apr. 18, 2007

(65) Prior Publication Data

US 2007/0253158 A1 Nov. 1, 2007

(30) Foreign Application Priority Data

Apr. 27, 2006 (NO) ..... 20061860

(51) Int. Cl.
*G01F 15/18* (2006.01)
*E21B 41/10* (2006.01)

(52) U.S. Cl. ..... 405/188; 166/338

(58) Field of Classification Search ..... 405/188, 405/190, 191; 138/338, 339, 340, 341
See application file for complete search history.

(56) References Cited

U.S. PATENT DOCUMENTS 4,120,362 A * 10/1978 Chateau et al. ..... 166/339
4,443,129 A * 4/1984 de Sivry et al. ..... 405/188
5,069,580 A * 12/1991 Herwig et al. ..... 405/188
6,068,427 A * 5/2000 Østergaard ..... 405/188
6,644,410 B1 * 11/2003 Lindsey-Curran et al. ... 166/338
7,181,980 B2 * 2/2007 Wium ..... 73/861.04
7,318,479 B2 * 1/2008 Williams ..... 166/341
2005/0241410 A1 11/2005 Wium
2008/0264643 A1 * 10/2008 Skeels et al. ..... 166/348

FOREIGN PATENT DOCUMENTS

GB 2 413 639 11/2005
NO 176154 9/1992

* cited by examiner

*Primary Examiner*—Frederick L Lagman
(74) *Attorney, Agent, or Firm*—Nixon & Vanderhye PC

(57) ABSTRACT

A subsea docking unit 2 including an electronic module for being removably connected to a subsea docking station 1 comprises a canister B containing electronics to be connected to the docking station, and a selectively, engageable locking device for locking the docking unit to the docking station. The locking device comprises one or more arm structures adapted for being pivotally mounted into a corresponding arm holding detail on said docking unit, and an actuator means for moving said arm structure in relation to one or more corresponding arm receiving and retaining details on said docking station, whereby a releasable locking engagement and disengagement of the docking unit and docking station is obtained. The docking station correspondingly comprises arm receiving and retaining detail adapted for receiving and retaining a docking unit. The docking unit and docking station are parts of a multiphase flow meter.

17 Claims, 20 Drawing Sheets

SUBSEA DOCKING SYSTEM FOR ELECTRONIC MODULES IN SUBSEA INSTALLATIONS

This invention is related to a subsea device. More particularly, this invention is related to a subsea docking system containing electronics, and where the docking units may be removably coupled to a subsea docking station, in order to provide removable installation of electronic modules in a subsea device.

The push for exploration of hydrocarbon resources at increasing sea depths and corresponding rough environmental conditions has driven equipment suppliers to develop solutions which can withstand higher pressures, higher temperatures, greater ocean depths, more vibrations and stronger shocks while also providing robustness in all aspects, low weight, a simple construction and redundancy. Thus there is a continuous demand for increasingly improved equipment for subsea environments. A part of this demand is fulfilled by providing equipment which is easy to install and also possible to remove or even replace in an easy manner.

In the prior art, United Kingdom patent application no. GB 2 413 639 A describes an apparatus and a method for being used to allow selective installation and removal of a subsea docking unit, such as one containing interface electronics to a mating connector on a housing, as illustrated in FIG. 1. The subsea docking unit of GB 2 413 639 A uses a locking mechanism disposed on the exterior of a retrievable subsea docking unit as illustrated in more detail in FIG. 2.

The known locking mechanism includes a handle, a hub and locking pins for securing the subsea docking unit to a multiphase flow meter. The locking mechanism may be selectively engaged or disengaged thereby allow securing of the retrievable subsea docking unit to the multiphase flow meter.

Even though the principles and detailed solution disclosed in GB 2 413 639 A provides a number of benefits in a subsea installation, it has been found that there is a demand for an even more rugged and secure attachment of a removable electronics module in such subsea devices, while maintaining the benefit of easy engagement and disengagement and still being able to retrieve the subsea docking unit including electronics.

Hence it is a main objective to provide a new and improved solution for mounting a subsea docking unit including electronics to a main body intended for a subsea environment which has a more rugged and secure attachment of the subsea docking unit including electronics to the main body, while maintaining the possibility of relatively simple mounting and dismounting, It is another objective of this invention to provide an improved solution for mounting a subsea docking unit including electronics to a main body in a subsea environment in a manner which is suitable for being operated using an ROV.

The objectives set forth above are achieved by providing, in a first aspect of the present invention, a subsea docking unit including an electronic module for being easily connected to and removed from a subsea docking station, said docking unit comprising a canister containing electronics for being connected to the docking station, and a selectively, engageable locking device for locking the docking unit to the docking station. The docking unit is characteristic in that the locking device comprises one or more arm structures adapted for being pivotally mounted into a corresponding arm holding detail on the docking unit, and an actuator means for moving said arm structure in relation to one or more corresponding arm receiving and retaining details on said docking station, whereby a releasable locking engagement and disengagement of the docking unit and docking station is obtained. Such a docking unit provides simultaneous movement and locking of a locking mechanism which can be produced in relatively few parts, with low weight and yielding a good locking of a docking unit to a docking station.

In a preferable embodiment of the docking unit according to the invention the actuator means comprises a leg structure having any number of legs, the leg structure being arranged so as to be capable of engaging the arm structure, thereby causing said locking engagement and disengagement.

In a preferable embodiment of the docking unit according to the invention there is provided actuator means comprising a set of legs extending first outwardly from a centre cross and subsequently bent to follow a peripheral surface of said docking unit. Such a shape of the actuator means enables the arrangement of locking brims distributed around a peripheral surface or contour of the locking station, thereby providing an effective locking of the docking unit.

In yet a preferable embodiment of the docking unit according to the invention the actuator means comprises a set of legs extending in a radial direction outwardly from a centre cross and arranged in an evenly distributed fashion around said centre cross. Such a common centre cross enables similar and simultaneous movement of all legs of the actuator means, meaning that all locking steps are performed substantially in one operation.

In a further preferable embodiment of the subsea docking unit according to the invention the actuator means comprises a tripod and the arm structure is a set of three three-armed structure, for allowing interactions of each leg of the tripod with at least one arm of each three-armed structure. Using three locking points has been found to be a preferable compromise between cost, weight and complexity. Also three support points are normally not too complicated to balance.

In a still further preferable embodiment of the docking unit according to the invention, the arm structure is provided with a protruding detail for providing a stopping function when the arm is in sliding contact with an external surface also having a similar protrusion. Providing a stopping function is important for achieving a locking of the docking unit to the docking station.

In yet a further preferable embodiment of the docking unit according to the invention there is provided a locking mechanism having a tripod whose three legs are designed to engage and push a set of three structures into a locked position within a recess or niche of said arm retaining detail, whereby said subsea docking unit is locked to the docking station.

In a further still preferable embodiment of the docking unit according to the invention there is provided an emergency release mechanism in the form of a set of stopping bars, at least one on each side of one of the tripod legs, in order in normal operation to limit a rotary movement of the tripod in relation to the docking unit, the stopping bars being mechanically designed and connected so as to be breakable and removable by a typical manipulator of a remote operated vehicle (ROV), thereby increasing the range of possible rotary movement of the tripod. The emergency release mechanism is desirable for enabling an alternative release mechanism in the event of malfunction or damage to the locking mechanism normally used to release the docking unit.

In a still further yet preferable embodiment of the docking unit according to the invention there are provided structures which are arranged so as to be pivoted in a plane substantially parallel with a longitudinal axis of a generally elongated docking unit. Having the pivoting of the arms in this plane is easily combined with a movement of the actuator means along a longitudinal axis of the docking unit and docking station, which enable the similar and simultaneous locking of all arms in one operation of the actuator means.

In a yet still further preferable embodiment of the docking unit according to the invention some selected or most of the external surfaces, preferably those for frictional contact with a with a docking station are coated with Xylan®.

The objectives set forth above are achieved by providing, in a second aspect of the present invention, a subsea docking station for lockingly engaging and disengaging a docking unit, the docking station comprising a main body defining a substantially internal volume for accommodating a docking unit, said main body including an electromechanical connector for connection to a corresponding connector on a docking unit. The docking station is characteristic in an arm receiving and retaining detail in the form of a niche or recess. The niche or recess defines an opening towards an inner volume, and the opening has a smallest width somewhat smaller than a widest width of the inner volume defined by said the niche or recess. By correct dimensioning of the details of corresponding locking details on a docking unit, the docking station is capable of allocating and locking a locking unit to the locking station.

In a preferable embodiment of a docking station according to the invention a set of arm receiving and retaining details are evenly distributed around a peripheral surface or contour of said docking station.

In yet a preferable embodiment of a docking station according to the invention a set of arm receiving and retaining details are arranged equally distributed along a periphery of the docking station as seen from a longitudinal centre axis of said docking station. In a further preferable embodiment of the docking station according to the invention the arm receiving and retaining detail is an integral part of a locking brim of the docking station. Typically, a locking brim is required to bridge a gap in the open gridlike frame of the docking station in order to provide good support for the arm receiving and retaining detail.

In a still further preferable embodiment of a docking station having locking brim, the arm receiving and retaining detail is located near an edge portion of a said locking brim, and the locking brim is aligned substantially along a peripheral surface contour of the docking station.

In yet a further preferable embodiment of the docking station according to the second aspect of the invention the arm receiving and retaining detail comprises a niche or recess having an internal protrusion on an inside surface for stopping against a corresponding protruding detail on an arm of a three-armed structure of a subsea docking unit for preventing or limiting a sliding action of said three-armed structure against a surface of the arm receiving and retaining detail when the docking unit is locked in the docking station. Such a shape of an arm receiving and retaining detail provides the docking station with a simple means of locking the docking unit to the docking station, provided the arm receiving and retaining detail is dimensioned to allocate corresponding parts of a locking mechanism on the docking unit. In a yet still further preferable embodiment of the docking station according to the invention some selected or most of the external surfaces, preferably those for frictional contact with a with a docking unit are coated with Xylan®.

In a third aspect of the invention the docking station and docking unit according to the invention are combined in a subsea multiphase flow meter. The flow meter comprises a funnel shaped subsea docking station, a retrievable subsea docking unit, adapted to be removably attached to the subsea docking station, a selectively engageable locking mechanism for locking the subsea docking unit to said subsea docking station. The flow meter is characteristic in that said locking mechanism comprises one or more arm structures adapted for being pivotally mounted into a corresponding arm holding detail on said subsea docking unit, and an actuator means arranged on said docking unit for moving said arm structure in relation to one or more corresponding arm receiving and retaining details on said docking station, whereby a releasable locking engagement and disengagement of the docking unit and docking station is obtained.

The invention will be further described in more detail in the following detailed description by reference to the appended drawings in which FIG. 1 illustrates an example of a prior art retrievable electronics subsea docking unit mounted in a funnel shaped main body.

Figure 1:
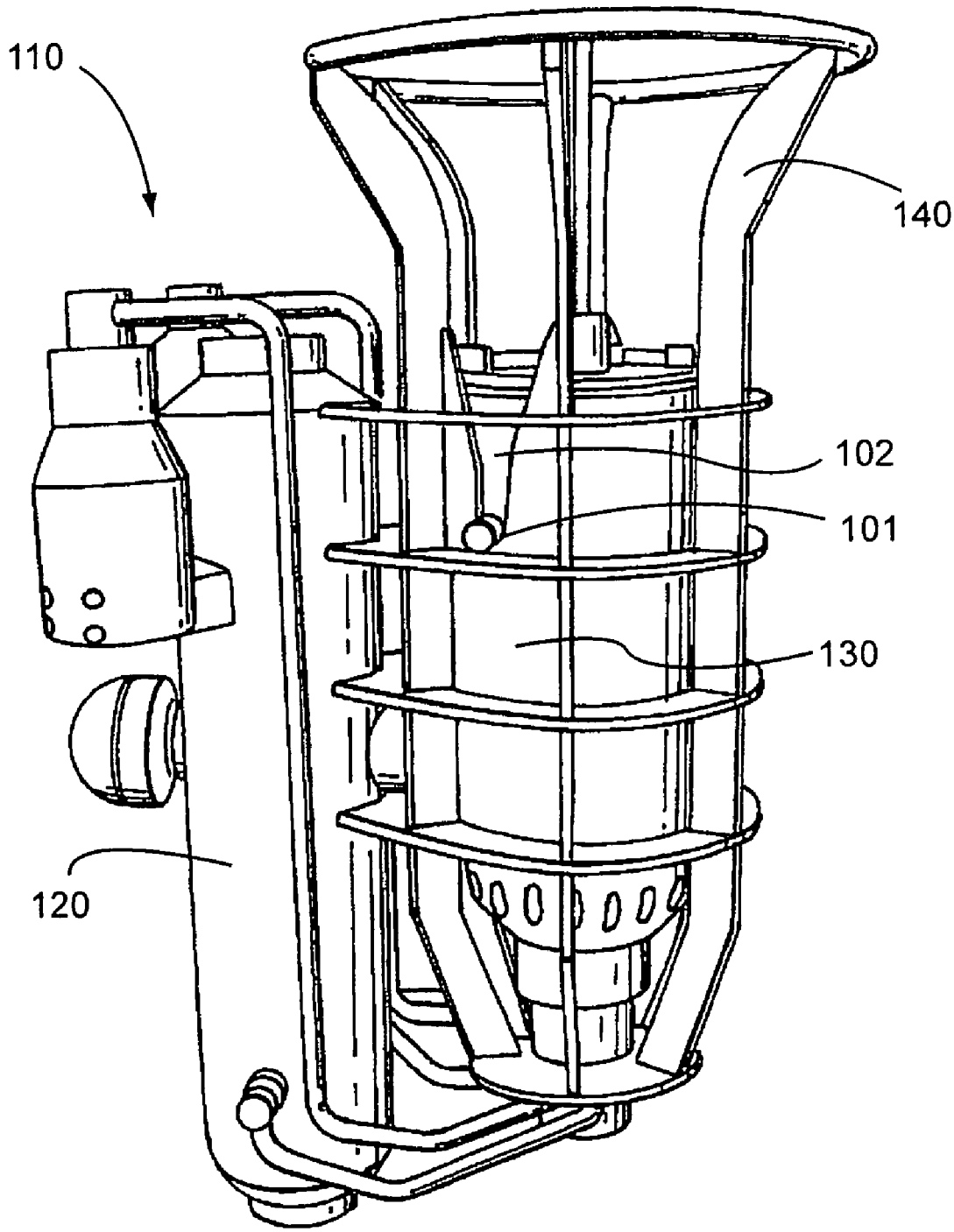
FIG. 1 (PRIOR ART)
Figure 2:
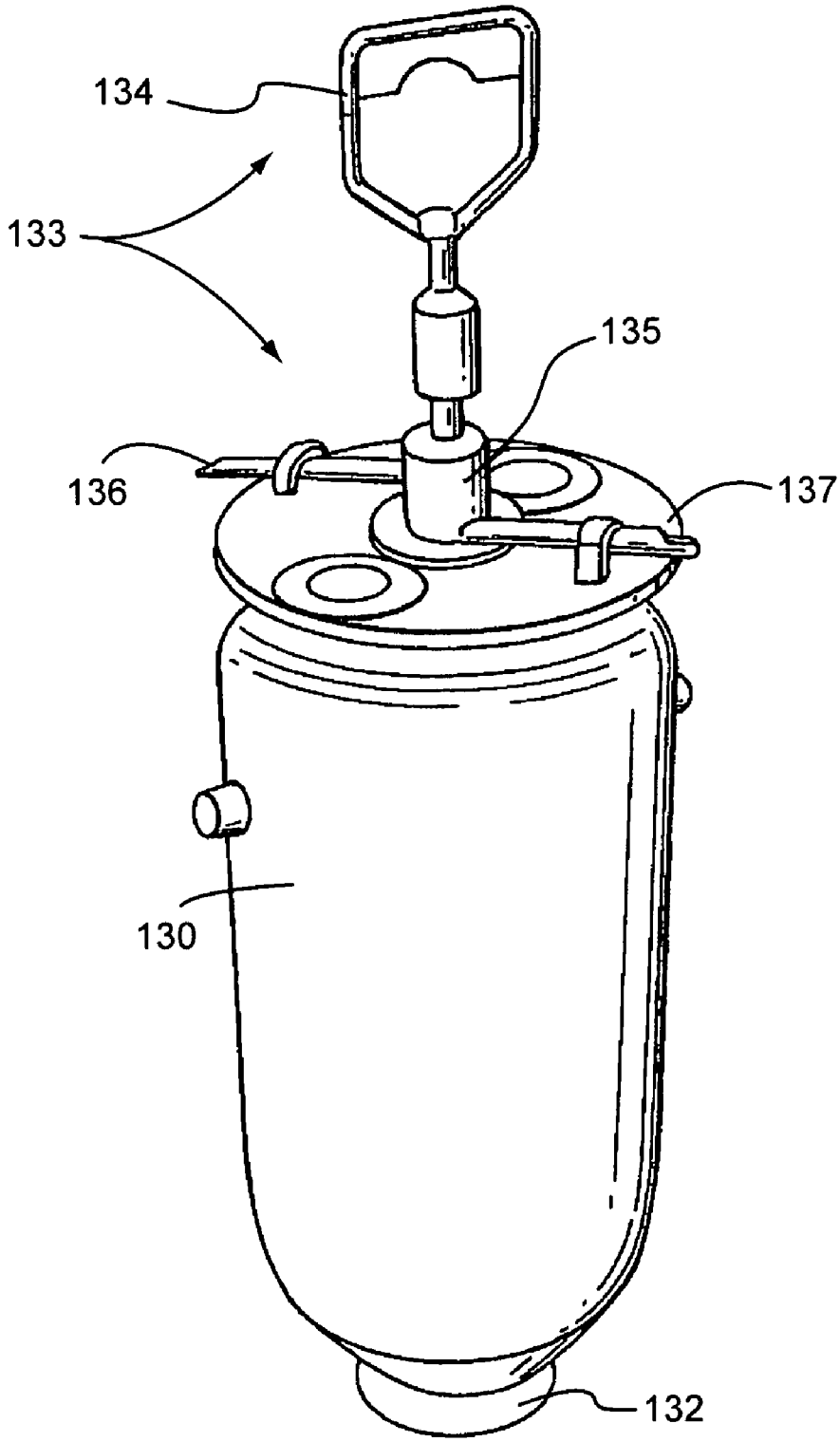
FIG. 2 (PRIOR ART)
FIG. 2 illustrates in more detail the locking mechanism for locking the retrievable subsea docking unit to a main body in the prior art solution disclosed in FIG. 1.

Referring first to FIG. 1 there is shown a known solution where an electronics subsea docking unit 130 is removably secured to a multiphase flow meter 110 in an otherwise known manner. The flow meter comprises a tubular housing 120 and alignment guides 140. FIG. 2 illustrates the locking details 134, 135, 136, 137 of the subsea docking unit 130 illustrated on FIG. 1.

Figure 3:
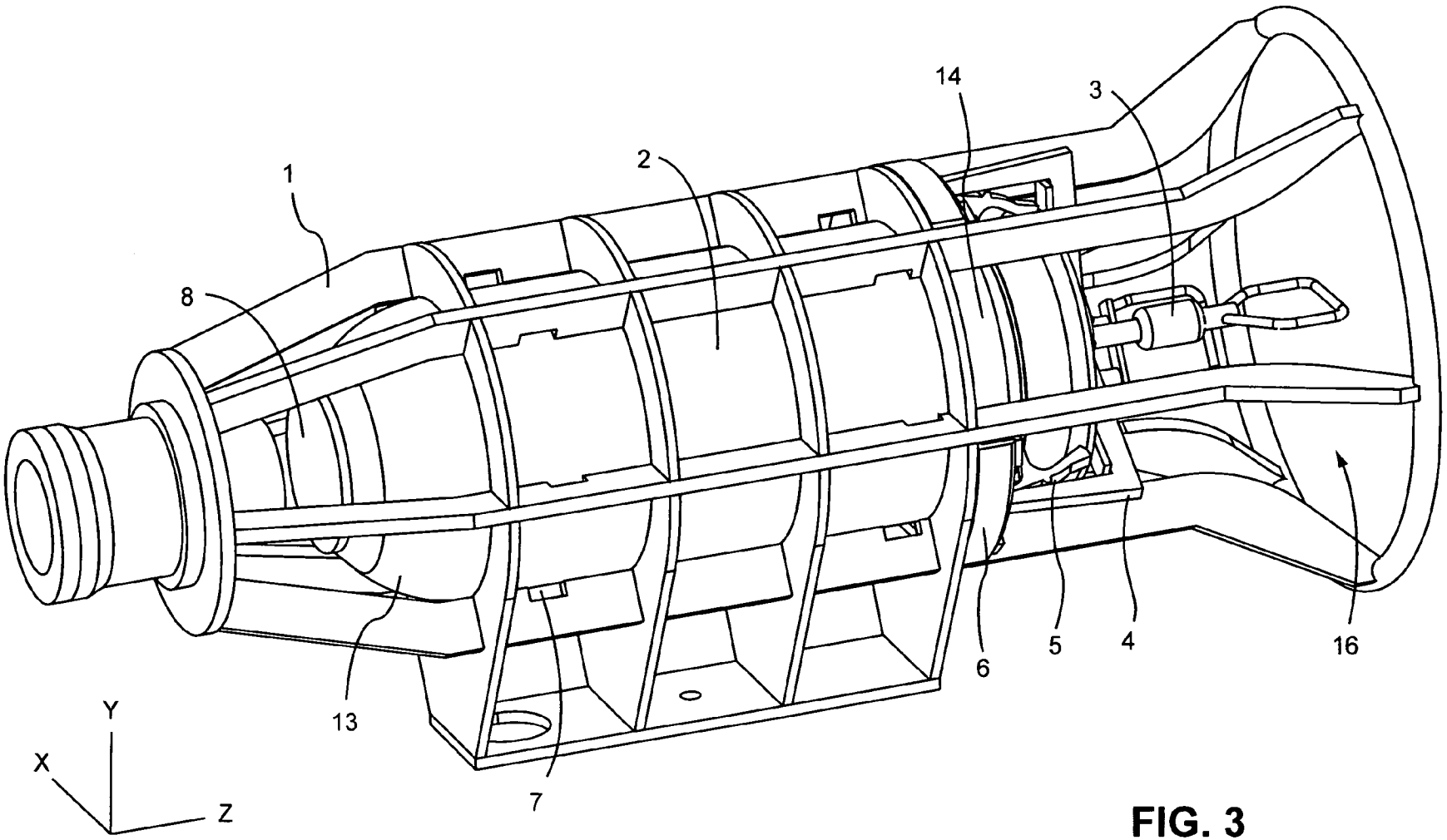
FIG. 3 is a perspective view of an example embodiment of a docking unit according to the invention coupled to a docking station according to the invention illustrating some of the main parts of the locking system.

Referring then to FIG. 3 there is shown an electronics subsea docking unit 2 according to the invention which is mounted in a funnel shaped subsea docking station 1. The subsea docking unit 2 is at one end provided with a connector 8 for mechanically and electrically connecting the subsea docking unit 2 at one end to the subsea docking station 1 and associated external components, for example for providing a complete control or measurement device, such as for example a multiphase fluid flow meter.

The present invention distinguishes itself significantly from the known solution in how the subsea docking unit is locked to the subsea docking station 1 and the associated locking device 3 which will be described in more detail below.

The subsea docking unit 2 which typically contains electronics for a control or measuring device and possibly also for communication, is preferably designed to have a substantially cylindrical shape having a spherical first end 13 in order to optimize the weight-strength relationship and for allowing a smooth entry of the subsea docking unit into the funnel shaped subsea docking station 1 and for reducing potential damage to the coating of the canister B.

On one side of the subsea docking unit 2 there is provided a rotation orientation detail 101, preferably a orientation guide for interacting with a corresponding slot 102, preferably of Y-shape, thereby allowing correct orientation of the subsea docking unit 2 when entering it into the subsea docking station 1, similar to the prior art docking station of FIG. 1. The subsea docking station 1 is advantageously designed as an open grid for allowing the flushing of debris, and improve the visibility for inspection, similar to the prior art solution illustrated on FIG. 1. Spring elements 7 are mounted inside the subsea docking station for aligning the subsea docking unit longitudinal axis with the subsea docking station 1 longitudinal axis. When the subsea docking unit 2 is oriented by the rotation orientation detail 101 and the spring elements 7, the subsea docking unit 2 and the subsea docking station 1 will generally be correctly aligned for mating the electrical/mechanical connector 8 of the first end 13 of the subsea docking unit 2 at the bottom of the subsea docking station 1 (as seen through the opening 16 of the subsea docking station). Preferably, the subsea docking station is mounted with the opening 16 normally facing upwards towards the sea surface of the sea, whereby the subsea docking unit is pushing downwards onto the connector 8 by its own weight in water, provided its weight/volume ratio is sufficiently large.

Figure 4:
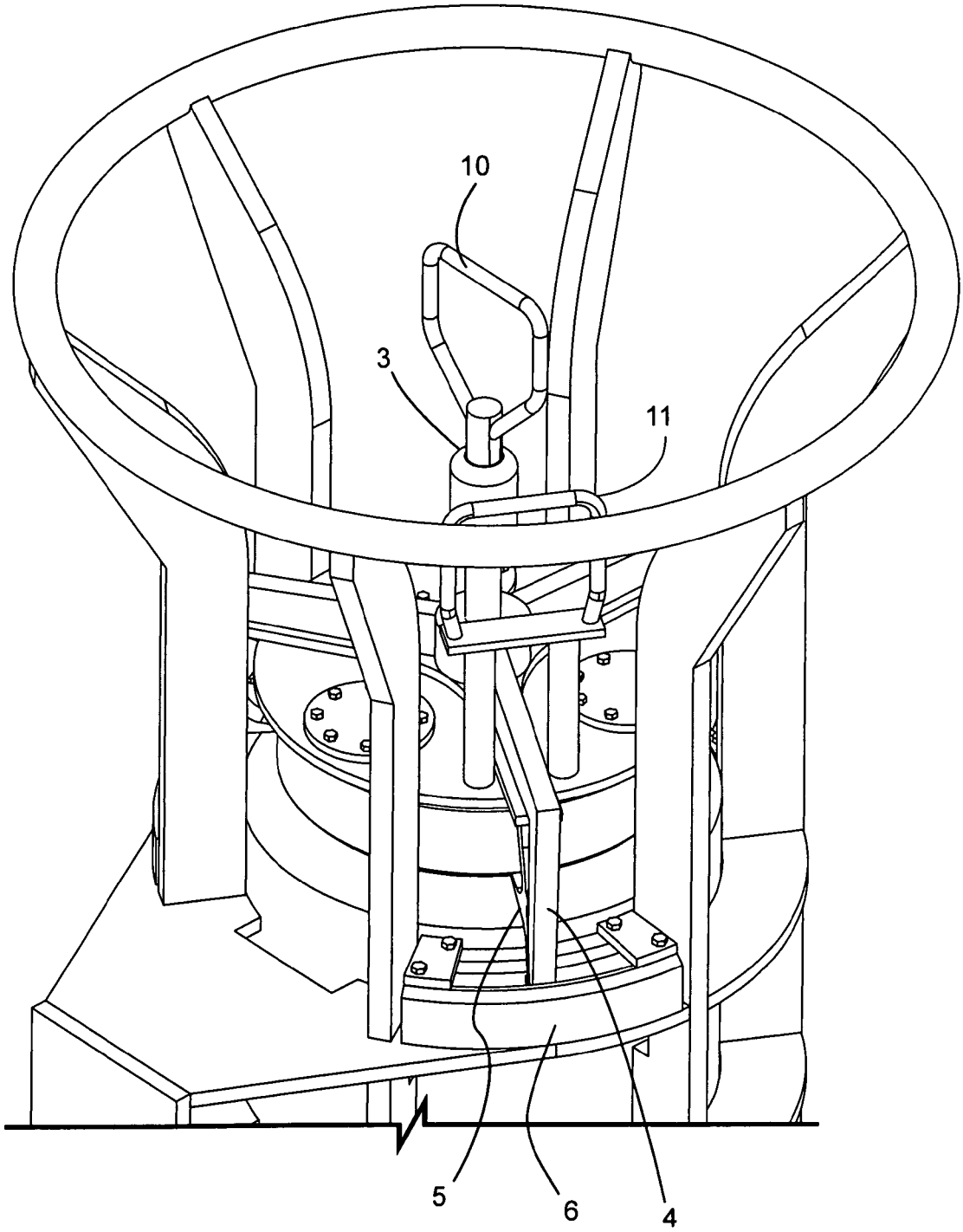
FIG. 4 is more detailed perspective view of the locking details of the docking unit as coupled to corresponding locking details of the docking station according to the invention.
Figure 5:
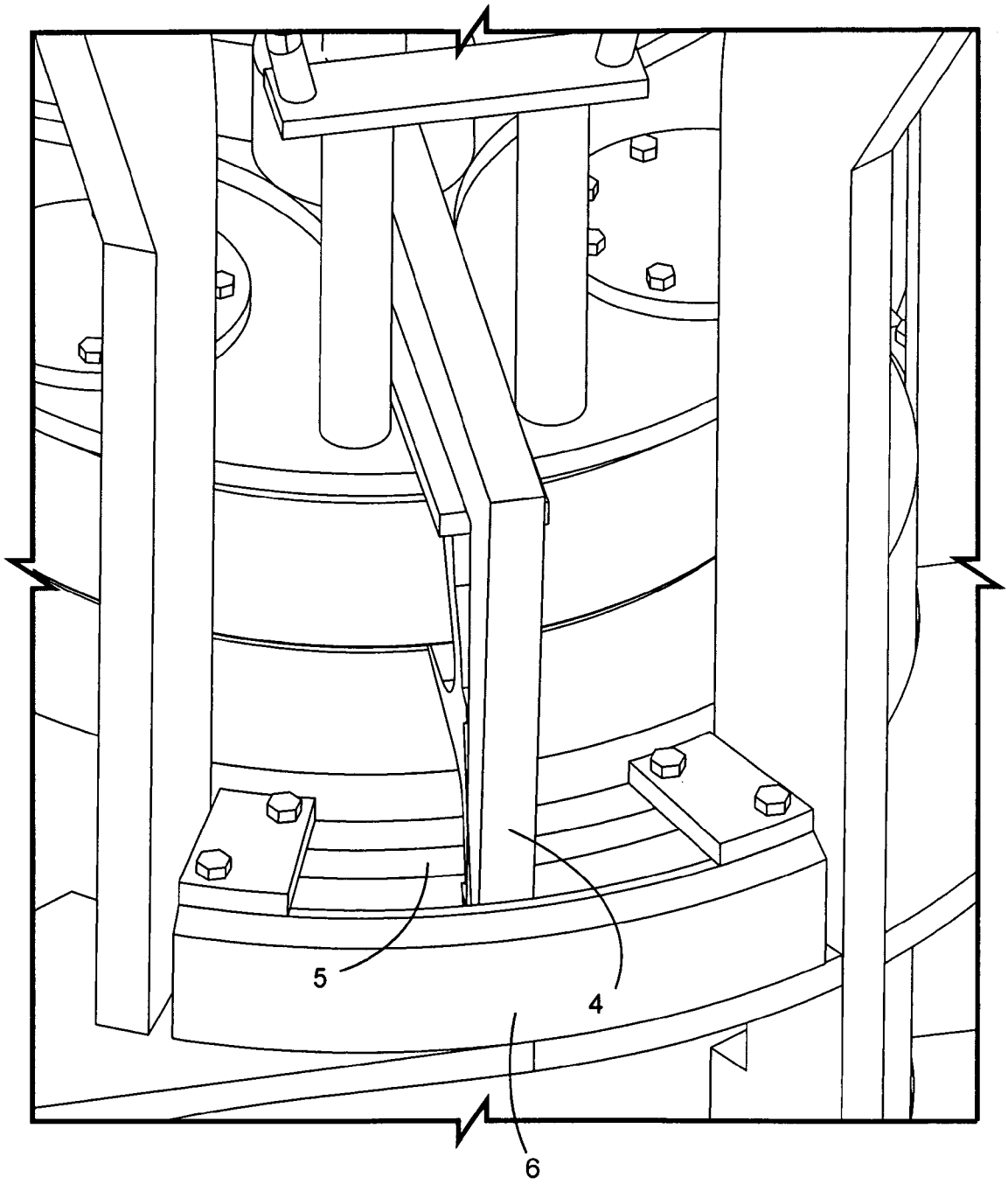
FIG. 5 is an even more detailed perspective view of the locking details of the docking unit as coupled to corresponding locking details of the docking station according to the invention.

On the second end 14 of the subsea docking unit 2, typically the top of the subsea docking unit when mounted in a subsea docking station in its normal position, there is provided a subsea docking unit locking mechanism 3 comprising movable parts which enables locking of the subsea docking unit 2 inside the subsea docking station 1. The subsea docking unit 2 locking mechanism 3 comprises movable parts which are designed to lock into a corresponding subsea docking station locking brim 6. The locking mechanism 3 of the subsea docking unit 2 comprises a set of arm structures 5, an example embodiment of which is illustrated on FIG. 8, each arm structure being preferably a three-armed structure 4, in that each arm structure has three arms. One arm of each three-armed structure is pivotally coupled to the second (top) end 14 of the subsea docking unit 2 and can be moved pivotally in a plane parallel with a longitudinal axis of the generally cylindrically shaped subsea docking unit 2 to couple a second arm of a three-armed structure with a locking brim 6 of the subsea docking station 1, as illustrated in FIG. 4 and FIG. 5.

A third arm of the arm structure can be oriented so as to stop against a part of the canister when arm structure is in or near the extreme position which allows the canister to be lifted out of the docking station 1. This stopping function limits the pivotal movement of the three-armed structure. When stopped in this manner the three-armed structure is at one of its extreme positions.

Figure 7:
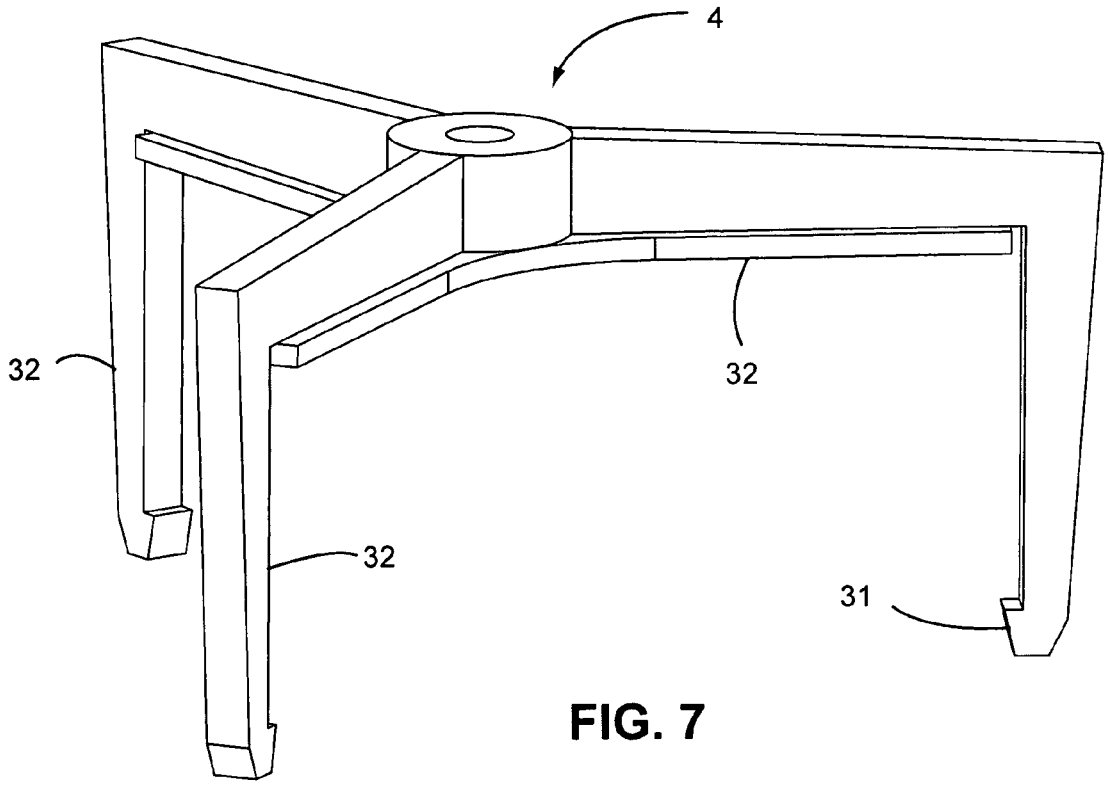
FIG. 7 illustrates a tripod being a part of the locking mechanism of the subsea docking unit according to the invention.
Figure 8:
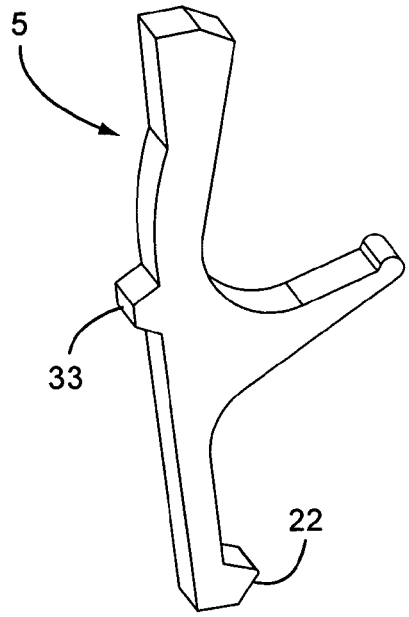
FIG. 8 illustrates the three-armed structure being a part of the locking mechanism of the subsea docking unit according to the invention.
Figure 9:
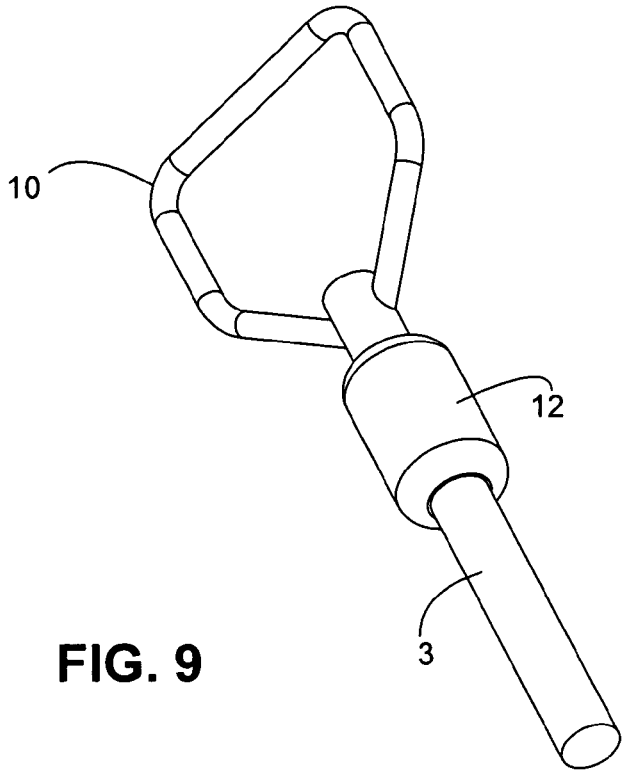
FIG. 9 is a detailed perspective view of the tripod rotary spindle or shaft attached to the docking unit and for lowering or lifting the tripod whereby locking or unlocking, respectively, of the docking unit is obtained.

The arm structures 4 can be actuated and moved between two extreme positions, a first locked position and a second unlocked position. The arm structures 4 can be locked and unlocked using an actuator means 3, 4 where an example embodiment is illustrated on FIG. 7 to FIG. 9, illustrating a leg structure 4 having a number of legs, each leg being arranged to engage an arm of a corresponding arm structure, and a spindle or shaft or rod-like structure 3, 10, 12 is coupled with a center part of the leg structure 4, the spindle 3 being arranged substantially parallel with an axis of the leg structure 4. The leg structure 4 is in a preferable embodiment made in the form of a tripod having three legs, for allowing each of three legs to engage with one corresponding arm of one of said arm structures 5. Even though a tripod-type leg structure is preferable, the leg structure 4 can in principle have any number of legs, and a number of arm structures 5 corresponding to the number of legs of the leg structure 4 is normally provided, however there could be more arm structures 5 than there are legs on the leg structure 4.

Figure 13A:
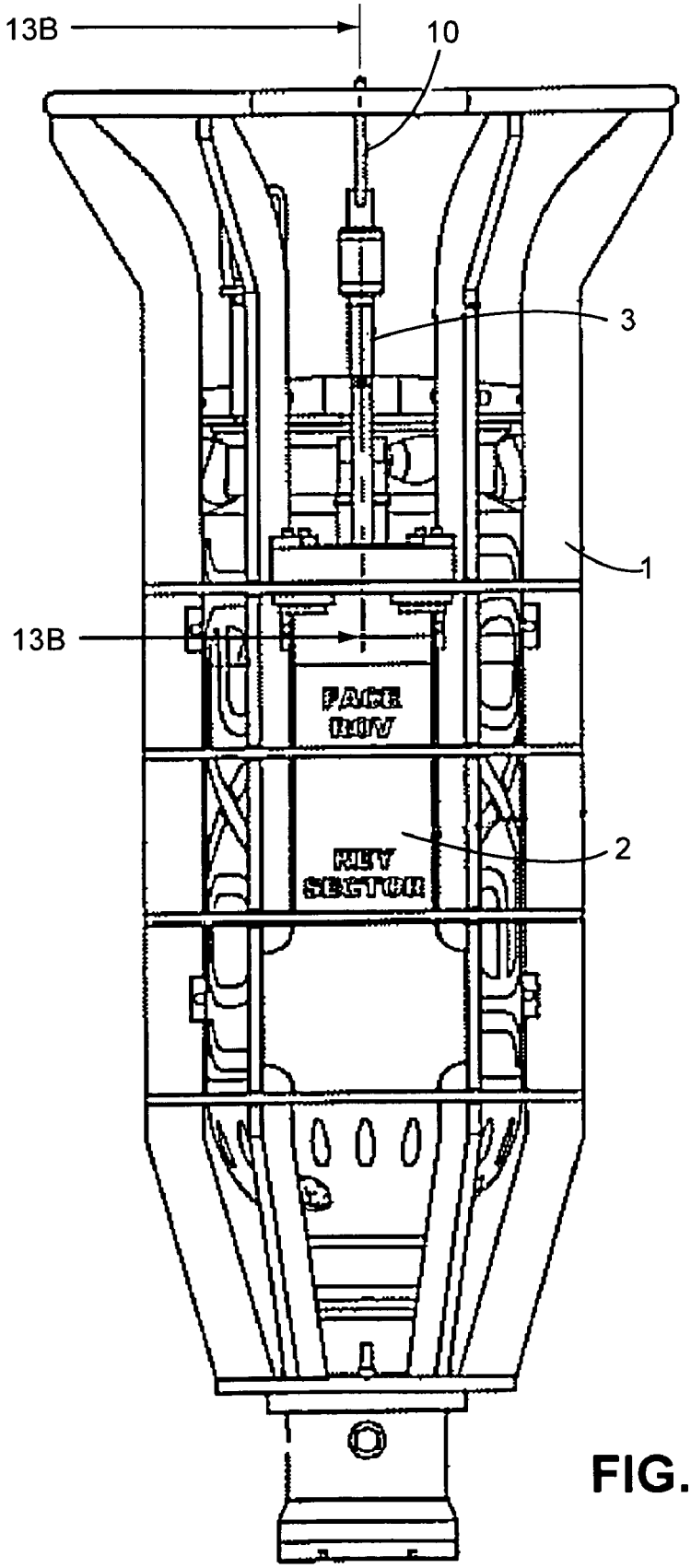
Figure 13B:
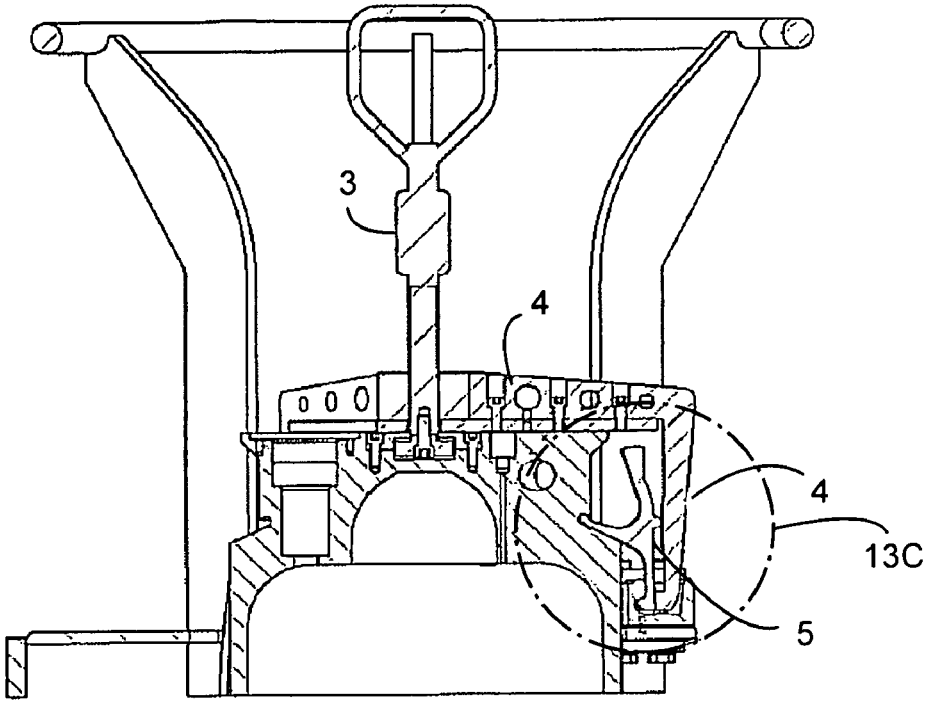

The leg structure 4 preferably has a leg protruding detail 31 at or near an extreme end of one or more legs 32 of the leg structure as illustrated on FIG. 7. The leg protruding detail 31 has performs a two-fold function, firstly it has the function of forcing an arm of an arm structure 5 towards an inner surface of a recess or niche 18 of a locking brim 6 when the arm and leg structures 4, 5 are being locked into the said locking brim 6 of the docking station 1 as illustrated on FIG. 13, section I, i.e. the leg protruding detail 31 assist in the locking function of the invention. Secondly, a leg protruding detail 31 of a leg 32 of a leg structure 4 may be designed so as to assist in pivoting a corresponding arm structure 5 about the pivot axis 19 when releasing a docking unit 2 from a docking station 1 as can be understood from section I of FIG. 10, where the protruding detail 31 of a leg 32 is in contact with a second protruding arm detail 33.

In the centre of the leg structure 4 a threaded spindle, shaft or rod-like structure 3 is arranged. The spindle 3 is possibly divided by a flexible joint 12 otherwise known per se, typically with an encapsulation of a flexible material such as for example a rubber, and the spindle 3 is preferably provided with a first paddle handle 10 at one end, and is removably attached to the subsea docking unit 2 at the other end. The tripod 4 can thus be actuated by rotating the spindle 3. The spindle 3 comprises a thread arrangement, preferably a trapeze thread arrangement, for engaging a corresponding thread arrangement on a center hole defined by in a centre of the leg structure 4. A leg structure 4 in the form of a tripod may thus be rotatably mounted, aligned with a longitudinal centre axis of the subsea docking unit, but can be freely rotated around this axis and moved along this axis within the limits given by the threaded shaft or spindle. By rotating the shaft or spindle 3, the tripod is moved towards or away from the subsea docking unit. This causes an arm of the three-armed structure to be pressed towards the centre axis of the subsea docking unit and to grab the locking brim 6.

Figure 6:
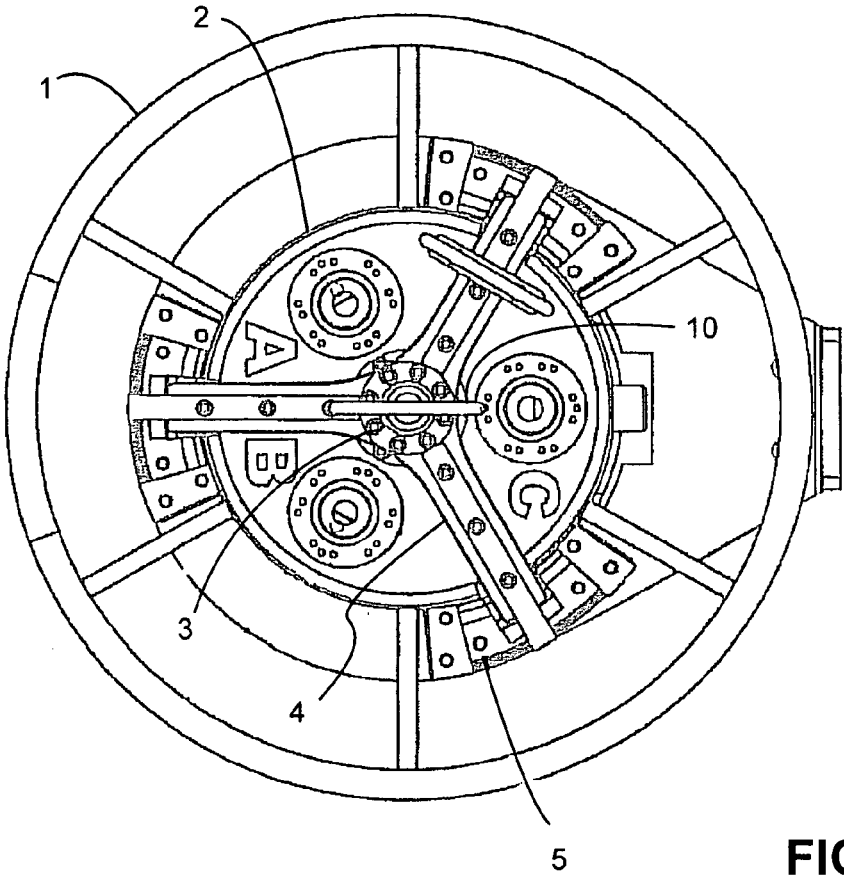
FIG. 6 is a top view of the docking unit according to the invention as arranged in the docking station according to the invention illustrating the arrangement of a tripod whose legs enclose a part of an end of the subsea docking unit of FIG. 3.

FIG. 6 illustrates how a tripod having three legs, illustrated in FIG. 9, can be arranged together with said threaded shaft or spindle 3 having a handle 10, for acting as an actuator means which can be operated by a manipulator on an ROV (not illustrated) or other another type of subsea manipulator otherwise known in the art, to push the on arm of each three-armed structure into a locked position inside the locking brim 6, by moving the tripod 4 towards the second end 14 of the canister B.

Preferably, the tripod 4 has legs evenly arranged around a centre axis, said tripod centre axis being parallel with a longitudinal centre axis of the canister B and the docking station 1 when mounted in their locked positions. With an even distribution of the legs of the tripod around an axis an even distribution of load forces around the periphery of the docking station 1 is ensured, which is advantageous from with regard to stability and a ruggedness of the docking unit 2 and the docking station 1, and also with regard to the locking mechanism itself.

Further preferably the actuator means comprises a three-legged structure such as a tripod, however other similarly symmetrically designed actuator means can be used, for example a four or five legged structure, provided the legs are arranged so as to each be able to push or pull a corresponding arm of a three-armed structure into a corresponding locking brim 6.

Figure 10A:
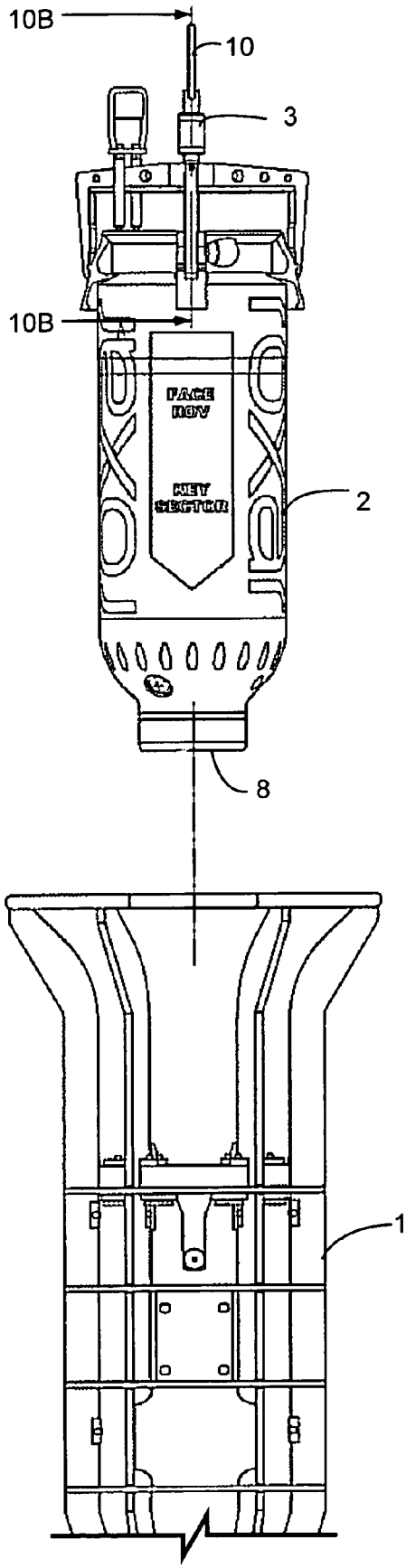
FIGS. 10A-13C illustrate in more detail the interaction of the tripod with the three-armed structure and the subsea docking unit in the two extreme positions and in two intermediary positions, illustrating the typical normal mounting and release operation of the subsea docking unit.
Figure 13C:
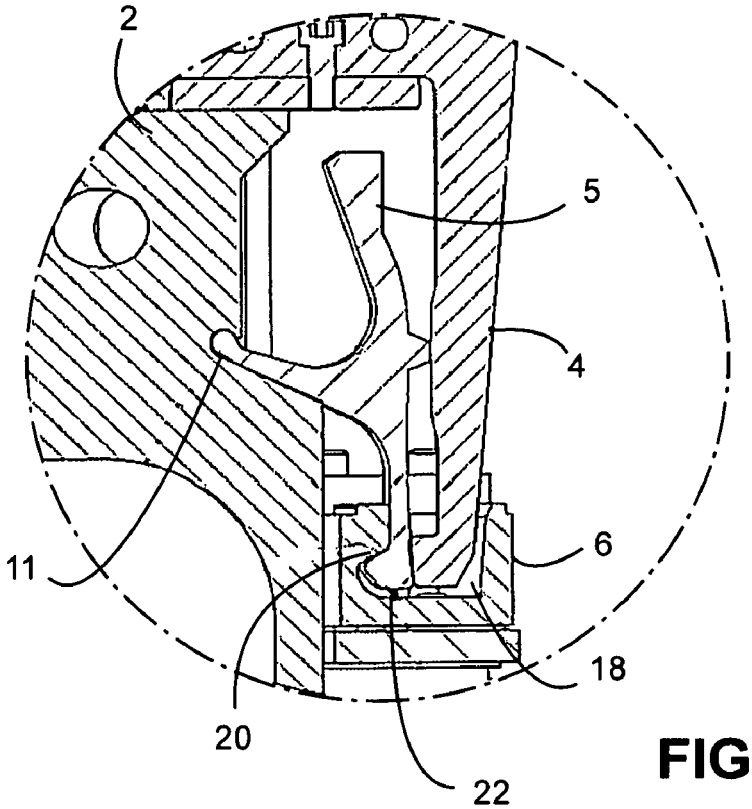
Figure 14A:
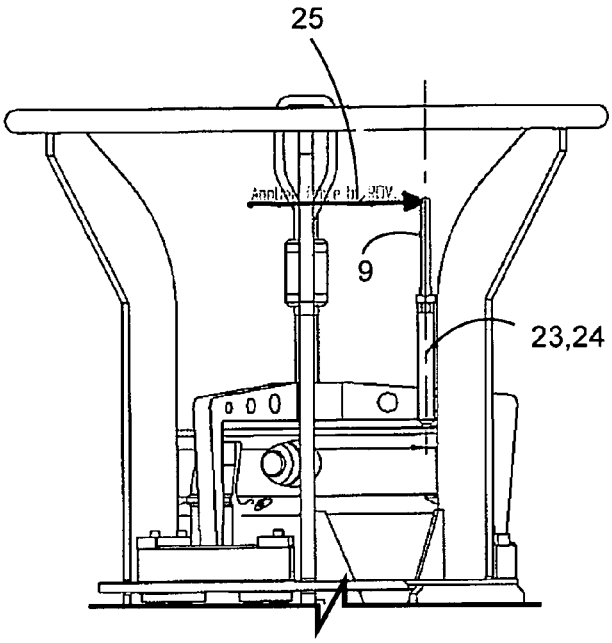
FIGS. 14A-16E illustrate a preferred embodiment and example of operation of an emergency release mechanism of the docking unit according to the invention.
Figure 14C:
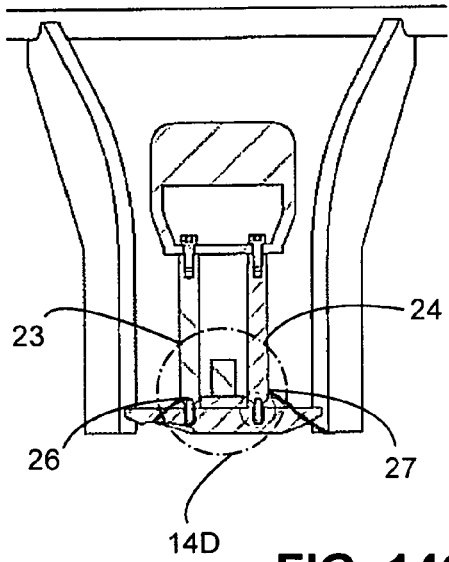
Figure 14B:
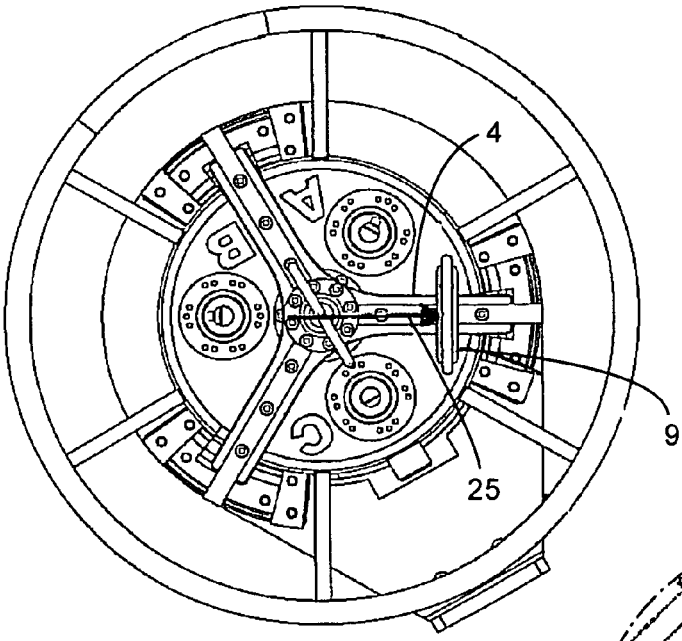
Figure 14D:
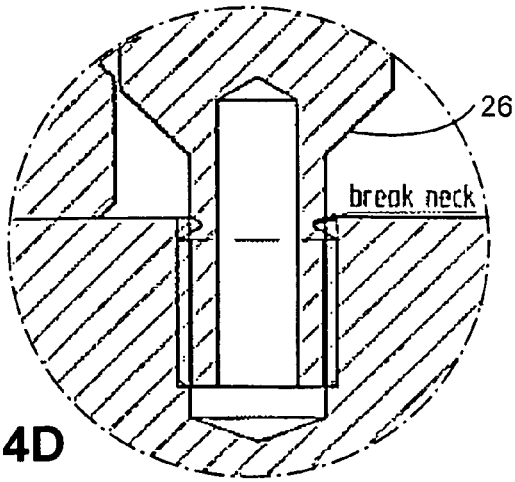

The operation of mounting the subsea docking unit 2 to the subsea docking station 1 is illustrated in more detail in the drawing sequence of FIGS. 10A-13C. In short FIGS. 10A-10C illustrate the situation where the docking unit 2 with a canister B is hanging freely with fully raised actuator means (tripod 3) and opened arm structure 5. FIGS. 11A-11D illustrate the situation when the docking unit 2 is standing upright in the docking station 1, still with fully raised actuator means (tripod) and opened arm structures 5. FIGS. 12A-12C illustrate the situation when the actuator means 3 are active (tripod is lowered) and the arm structures 4 are starting to get contact with the locking brim 6. FIGS. 13A-13C illustrate the situation where the docking unit 2 with the canister B including electronics is locked to the locking brim 6 of the docking station 1 with fully lowered actuator means 3 and closed arm structures 5.

Figure 10B:
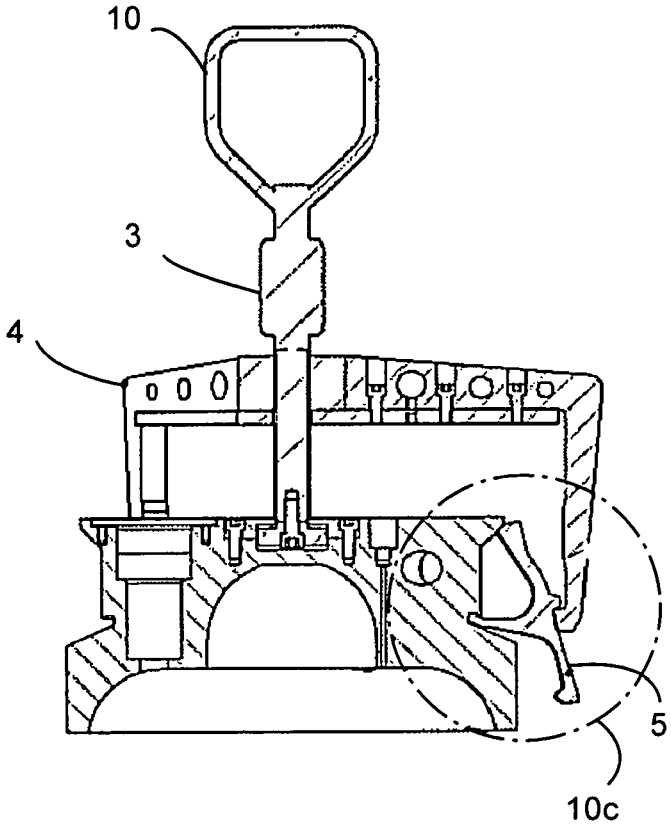
Figure 10C:
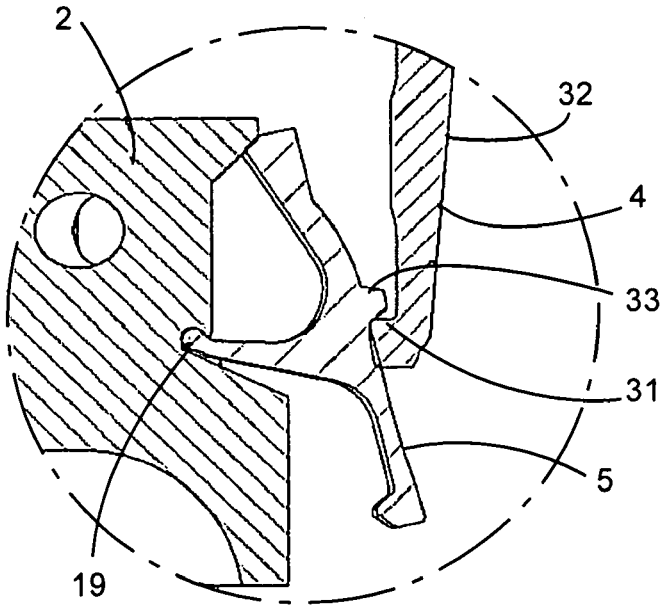
Figure 11A:
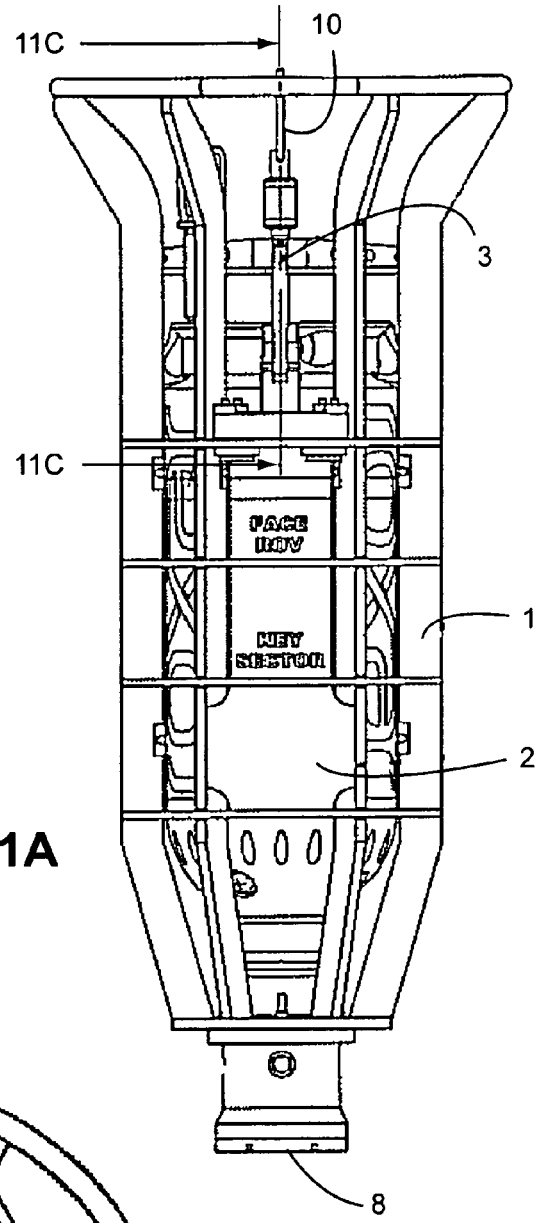
Figure 11B:
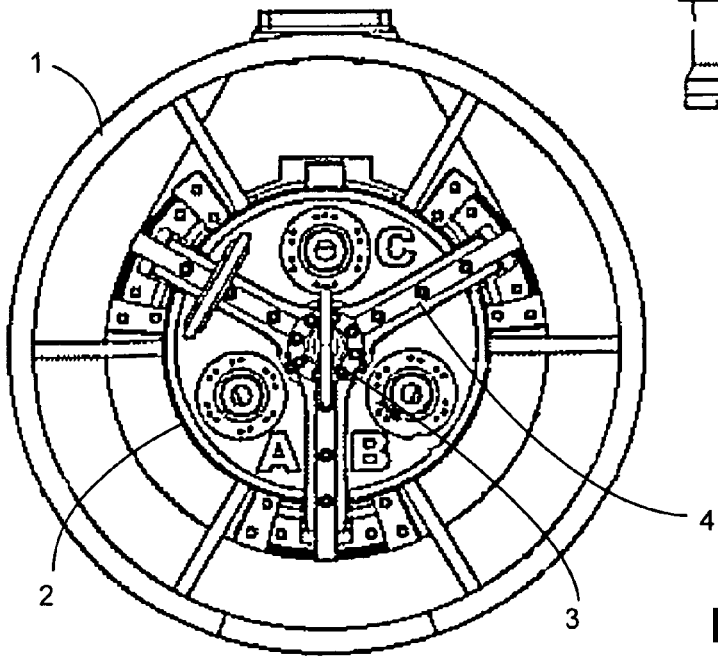
Figure 11C:
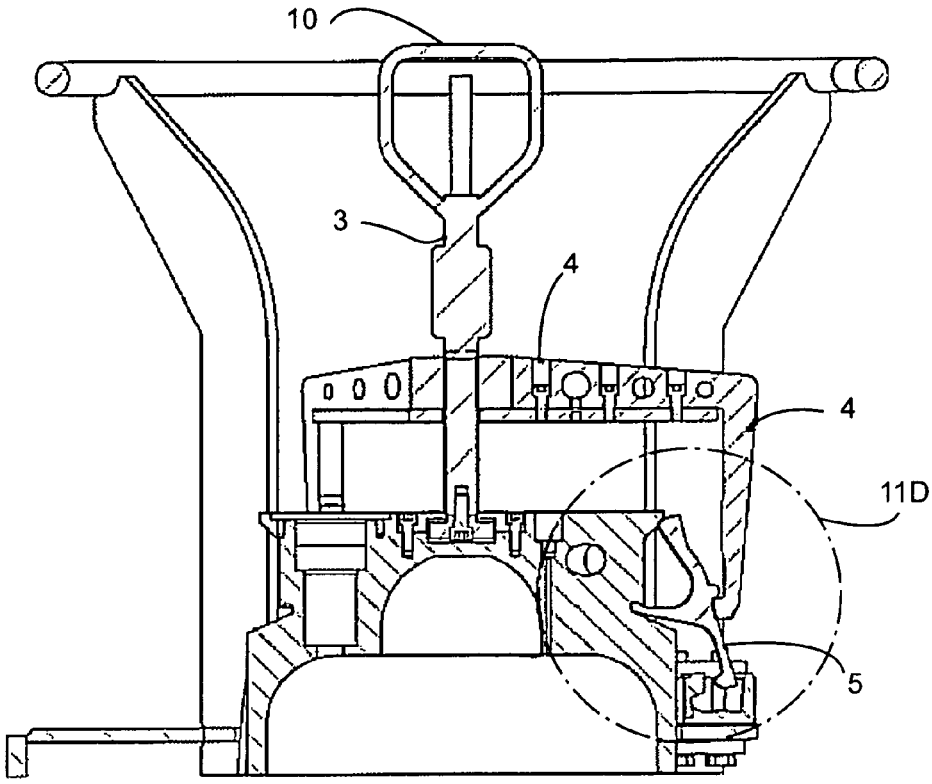
Figure 11D:
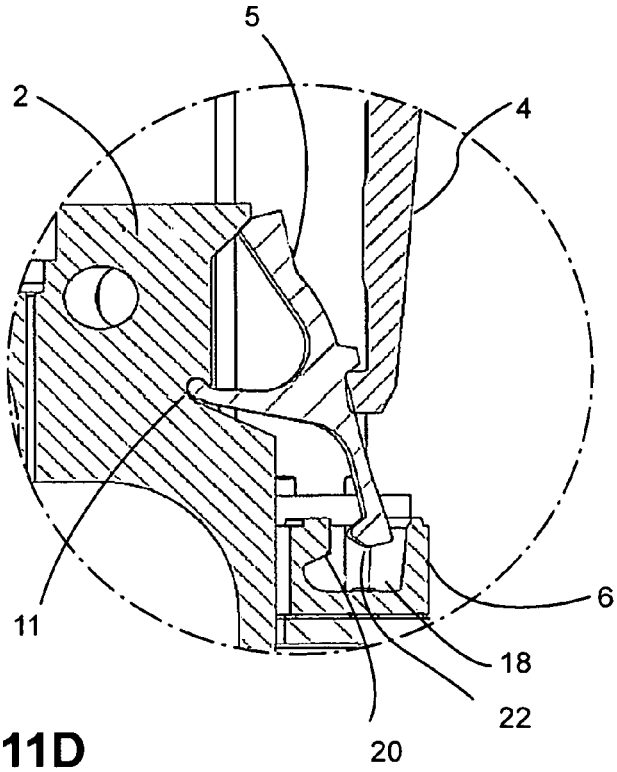
Figure 12A:
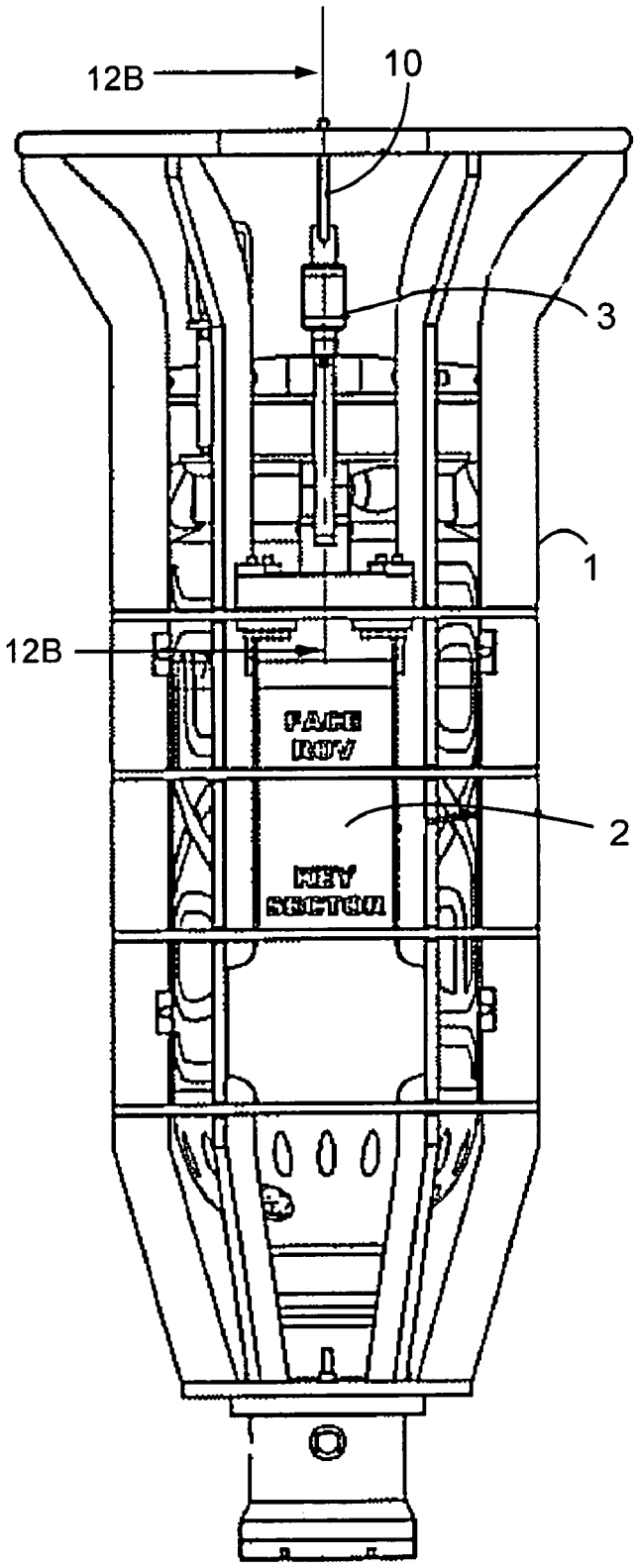
Figure 12B:
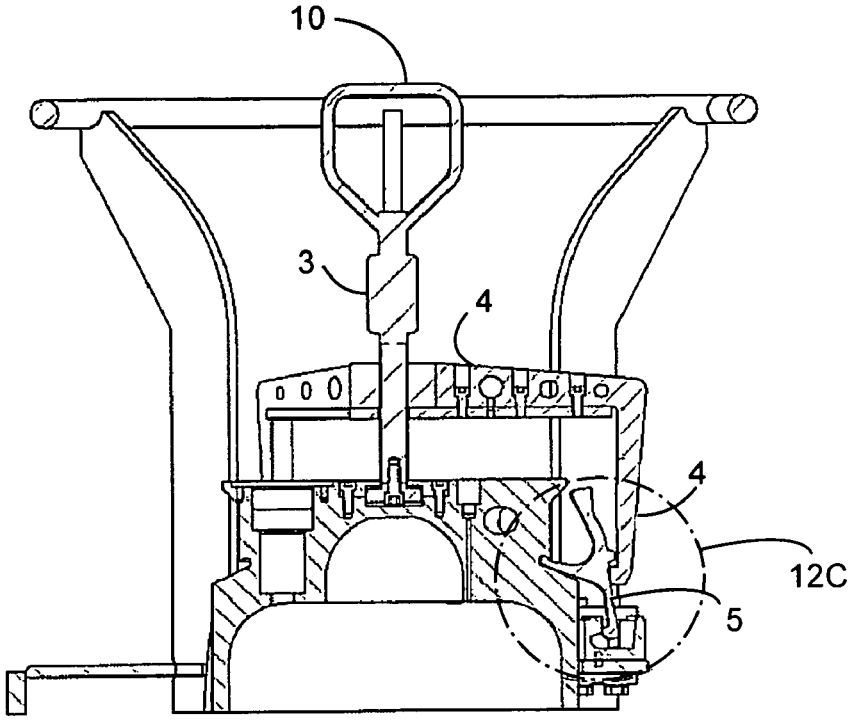
Figure 12C:
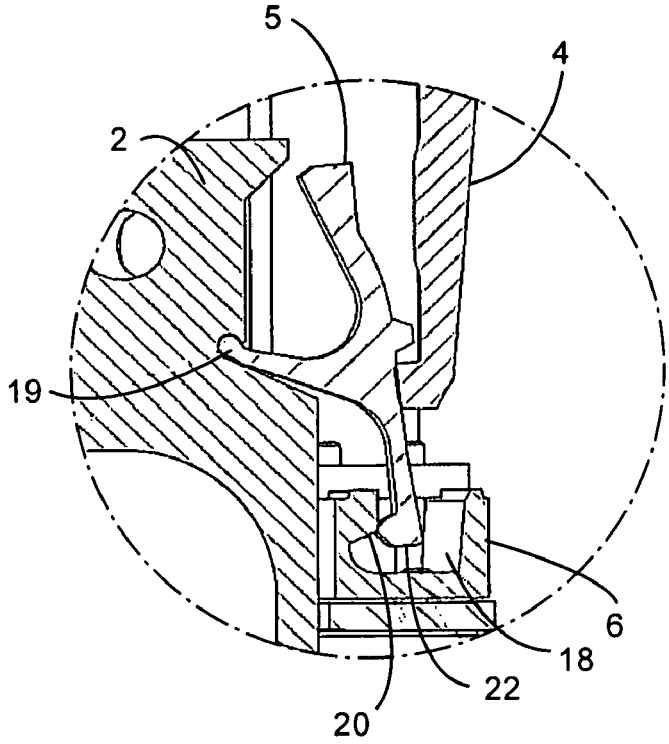

FIGS. 10A-10C illustrate one extreme initial position where all main forces acting between the subsea docking unit 2 and the subsea docking station 1 in the x-, y-, and z-axis will be transferred through the three-armed structure 4 and into the tripod 4. By designing the locking brim 6 on the subsea docking station 1 in a substantially U-shaped niche or recess, the tripod 4 can perform a second function. An arm of the three-armed structure 4 will be pushed inside the U-shaped recess by a leg of the tripod 4. Then the leg of the tripod 4 and three-armed structure 4 substantially fills the recess, whereby the subsea docking unit is in a locked position as long as the tripod 4 locking operating is not reversed. In the locked position all the main forces acting between the subsea docking unit 2 and the subsea docking station 1 in line with the X, Y and Z-axis will be transferred directly to the three-armed structures and U-shaped niche or recess of the subsea docking station rim 6, leaving the tripod 4 with the function of holding one arm of each three-armed structure in the appropriate position inside the U-shaped niche or recess. Hence the tripod 4 can be a relatively lightweight element as it normally does not transfer very high forces.

As stated above, the tripod 4 is normally initially free to rotate. By rotation of the threaded rod, there will normally be sufficient friction between the rod and the tripod to cause such rotation. To avoid such rotation, there is arranged a pair of metal bars, a first bar on one side of the at least one tripod leg and a second bar on the opposite side of said one tripod leg in order to present a hindrance or obstacle to such rotation. Preferably, the pair of metal bars are mounted on an external surface of the subsea docking unit, next to a portion of the tripod leg which is directed radially, outwardly from a common center cross of the tripod legs. The threaded shaft or spindle 3 passes through a center hole in this tripod cross. After placement and locking of the subsea docking unit in position in the subsea docking station 1 the pair of metal bars is preferably coupled at one by mounting a second paddle handle 9.

A good design principle and often a requirement of such equipment is that it should be provided with an override release mechanism or, in other words an emergency release mechanism. This mechanism is to be used when there are movable parts or systems that will not operate as designed and provides a highly desirable redundancy for parts that can be expected to stay on the seabed for a typical design life of 30 years. The key requirement is to be able to unlock the subsea docking unit using an alternative manner without causing damage to the stationary parts.

The pair of metal bars 23, 24 hindering the rotation of the tripod, and the associated second paddle handle 9 can be arranged so as to enable a new type of emergency release mechanism in this invention, as also illustrated in more detail in the sequence of FIGS. 14A-16E. In short, FIGS. 14A-14D illustrate in section I how an ROV in a first step on an emergency release operation can apply a force in a first direction, indicated by the arrow 25 on the second paddle handle 9 to cause a breakage of the bars 23, 24 at respective weakened sections 26, 27 of the bars. The weakened sections 26, 27 are illustrated in more detail in FIG. 14C, and in still more detail in FIG. 14D. FIG. 14B illustrates a top view of the application of a force in said first direction 25 on the second paddle handle 9.

Figure 15A:
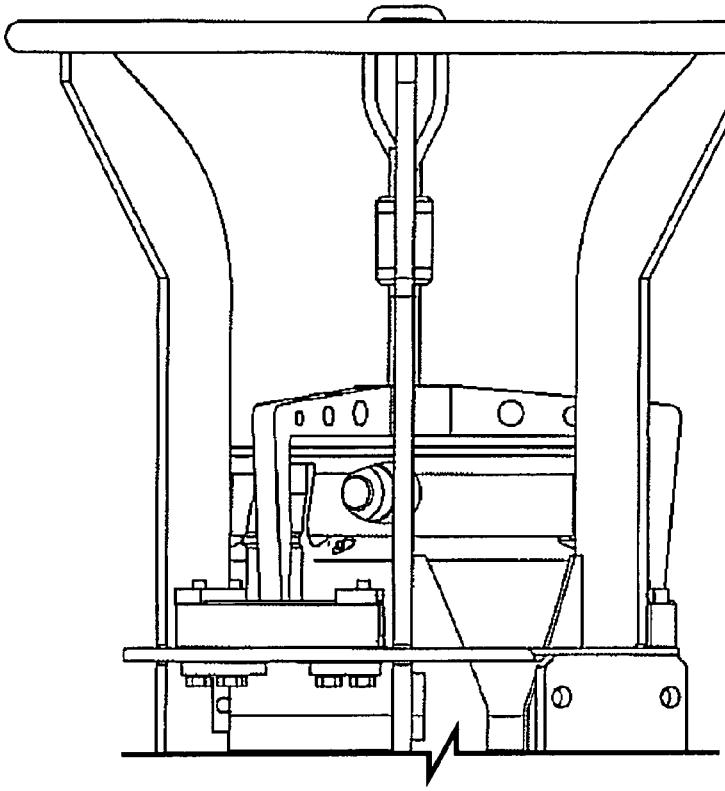
Figure 15B:
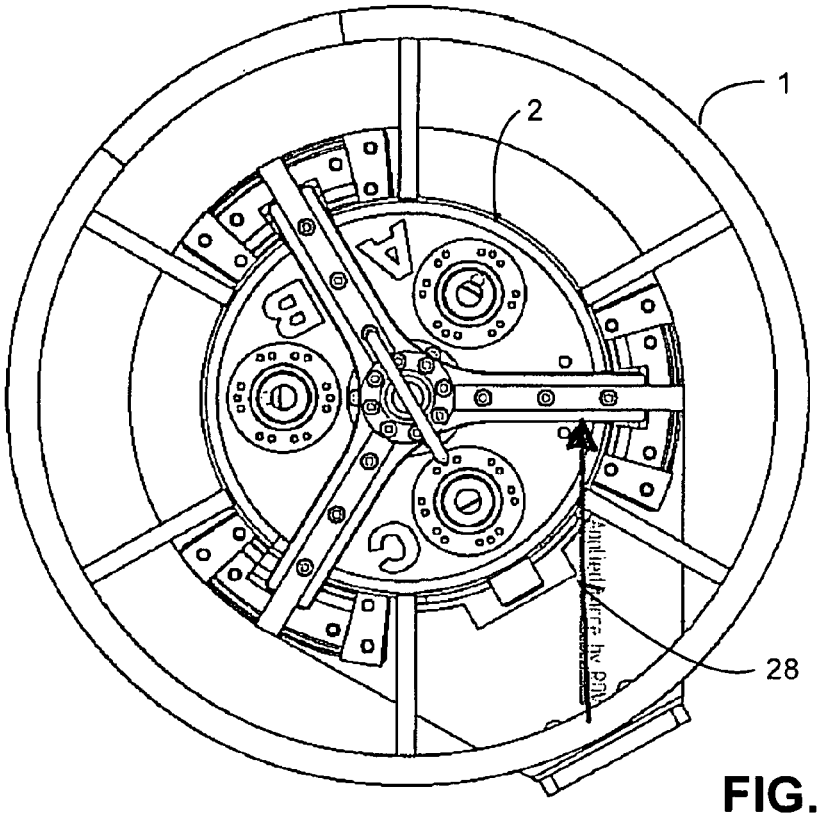

FIG. 15B illustrates how an ROV in a second step on an emergency release operation can apply a force in second direction 28 onto the tripod 4 in order to force it to rotate around its center axis. The force is applied in the second direction 28 onto one of the legs of the tripod, thereby releasing the arm structure 5 which locks the canister B to the locking station 1.

Figure 16A:
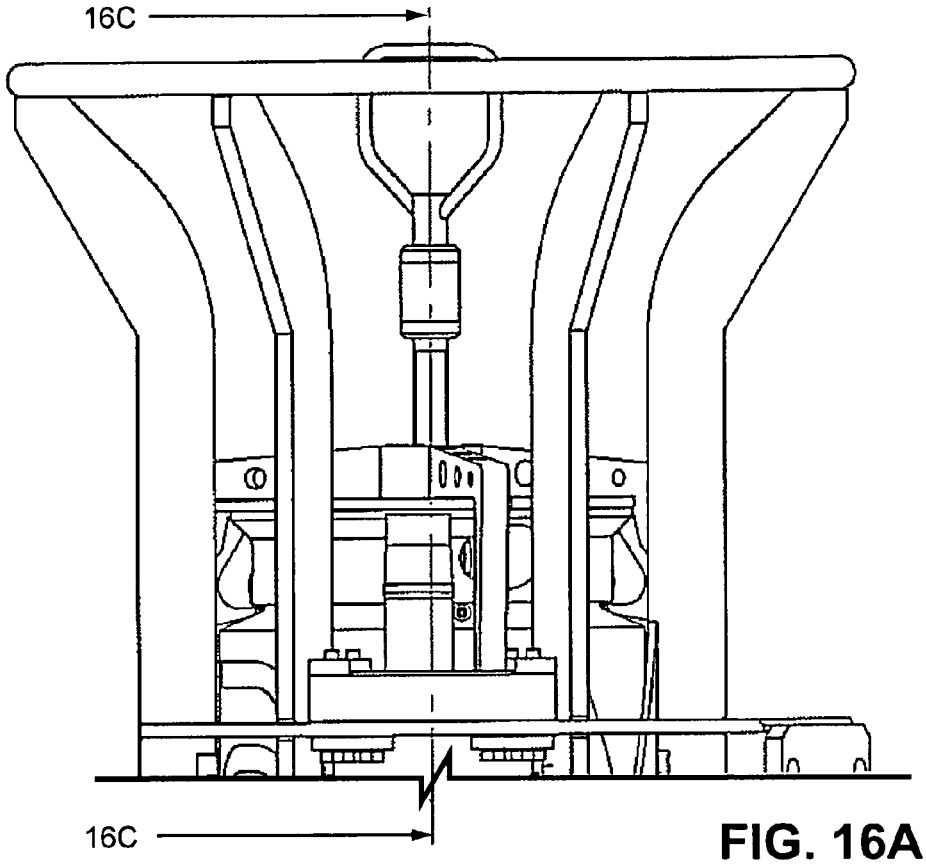
Figure 16B:
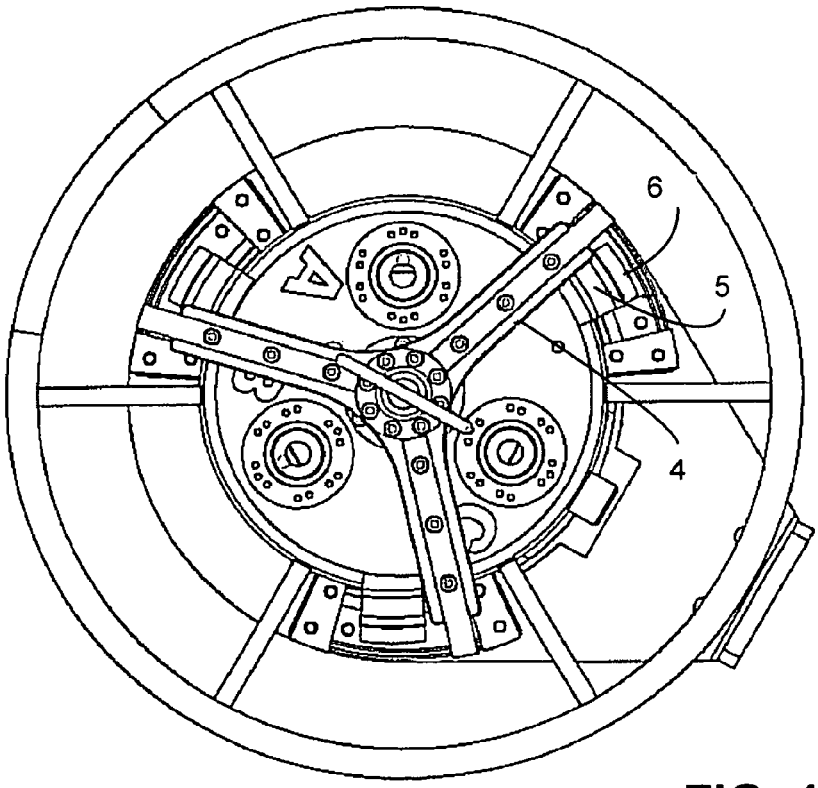
Figure 16C:
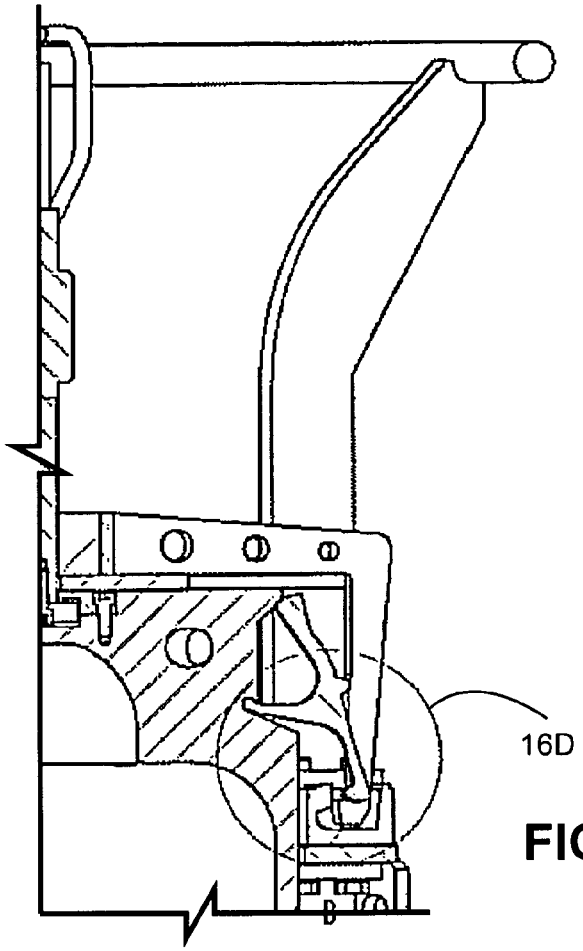
Figure 16D:
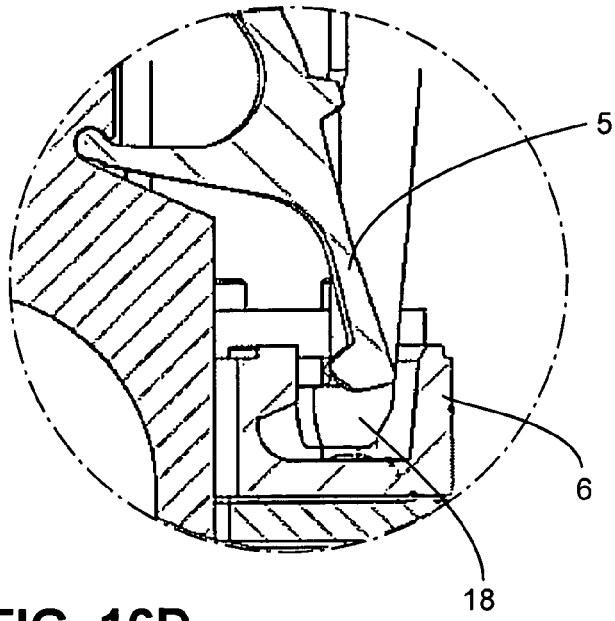
Figure 16E:
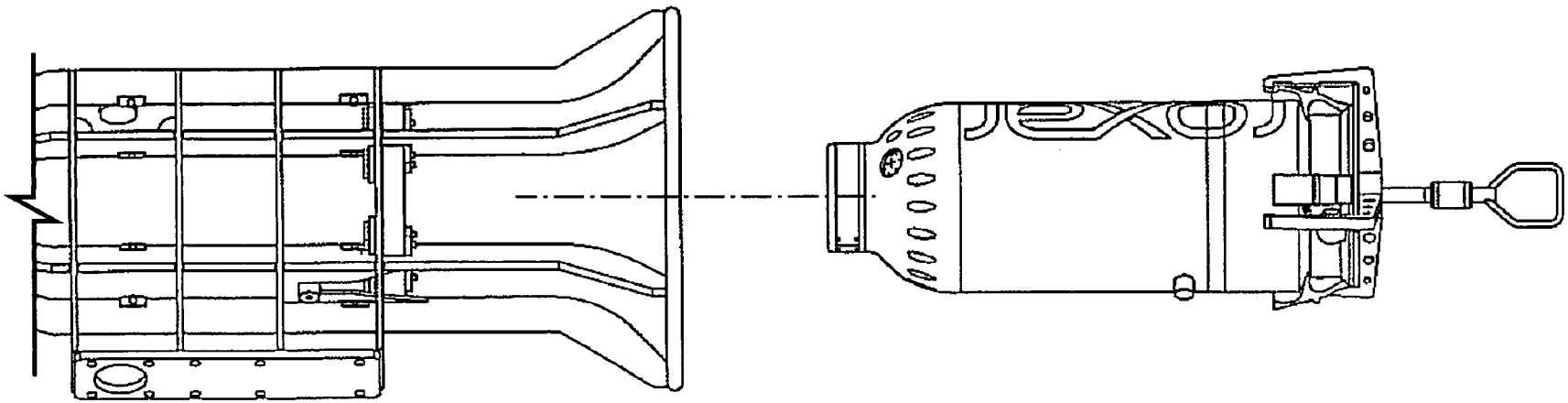

FIGS. 16A and 16B illustrate how the tripod 4 has been rotated to an extreme position where its legs does not engage the arm structures 5, thereby enabling the arm structures 5 to be disengaged from the locked position within the niche or recess 18 of the locking brim 6 of the docking station 1, as shown in FIG. 16C and in the enlarged view of FIG. 16D. This way a separation of the docking unit 2 from the docking station 1 is possible, as shown in FIG. 16E.

The three-armed structure and the tripod legs are not made very wide, in order to optimize weight and cost of the subsea docking unit. The sector within which the tripod could be rotated freely, disregarding the second paddle handle 9 is typically about 30 degrees. By rotating the tripod 4 in a somewhat more limited manner, say about 10 degrees in either direction, this will cause the tripod legs to slide off the arms of the three-armed structure, thereby freeing the locked arms of the three-armed structures from the locked position in which they are maintained in place. By enabling such a rotation of the tripod, the subsea docking unit 2 will be free to be retrieved without having to rotate the first paddle handle. In order to enable such a function, the second paddle handle 9 is designed to be capable of being broken off the subsea docking unit By a manipulation device on an ROV, it could for example be designed to break off by use of 80% of the capacity of an ROV manipulation arm. Thus, an ROV can break off the second paddle handle 9, operate the manipulation arm on the first paddle handle to cause a rotation of the tripod, thus releasing the subsea docking unit from its locked position.

By manufacturing the various parts of the locking mechanisms to tight tolerances it is enabled that the subsea docking unit may be forced and pressed into the subsea docking station by a constant force when the locking mechanism is locked. This may be achieved by an undercut on the tolerances of the locking mechanism. This way the force generated by the locking mechanism can be designed to be larger than the resulting forces of the typical G-forces or vibrations which may be expected. As a result of the forces acting and the properties (elasticity modules), an arm of the three-armed structure will always be in contact with the brim 6 of the subsea docking station 1, thus ensuring that the connector 8 is fully engaged and avoiding a hammering of the materials in any of the shock loads or vibration scenarios that can be expected.

Preferably, the parts of the locking mechanism, the subsea docking unit Body and the subsea docking station which can, by shock, vibration and fatigue analysis, be expected to be subjected to high stress is made from grade 5 titanium, or materials of similar strength/weight ratio levels. The remaining parts are preferably made from a grade 2 titanium, or a material of similar properties, thereby achieving a reduced total weight of the total structure.

The emergency release mechanism, the tolerance requirements and the operation of the system require low friction surfaces. After careful analysis of a number of possible materials, it was found that the friction surfaces of contact between the locking unit and locking station are preferably are coated with Xylan®. Xylan® has a number of desirable properties. It yields a coating with very little variation in thickness when applied, it has an extremely low friction and it is approved as a corrosion protector for carbon steel wellhead caps. It also has a very good compatibility with titanium and can be applied without damaging the oxide layer, thus providing the titanium with the special corrosion resistant property. Hence, by using Xylan® coatings on selected or most surfaces of the components, i.e. the docking unit or docking station of the present invention, it is possible to obtain low friction when inserting the subsea docking unit into the funnel, when operating the looking mechanism and when using the emergency release mechanism.

A field qualification test of a prototype of an example embodiment of the present invention has yielded very successful results. Operators of ROVs have confirmed that the present invention yields easy operations and has a very robust design. No possibilities for wrong installation of subsea docking units have been experienced this far.

Although the invention is primarily directed at applications in which a docking station is fixedly mounted as part of a subsea installation, the docking station could just as well be a part of a mobile subsea unit while still being able to interact with a docking unit according to the invention having the same advantages as described above.

In summary, the present invention provides a docking unit and an associated docking station for allocating said docking unit which enables placement of removable electronics as part of a subsea installation in a manner which in operation can withstand more severe chocks and stronger vibrations than present solutions. Further this result is obtained with in a solution which enables fast, easily reproducible mounting and removal of a docking unit including electronics for a subsea installation.

Typical applications include all types of control and measuring instrumentation modules, for example a subsea mounted multiphase fluid flow metering device, however a person skilled in the art will appreciate that the present invention may be applicable to other types of subsea installations requiring removable electronics.

The invention claimed is:

1. Subsea docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, wherein the actuator means comprises a set of legs extending in a radial direction outwardly from a centre cross and arranged in an evenly distributed fashion around said centre cross.

2. Subsea docking unit according to claim 1, wherein the actuator means comprises a leg structure having any number of legs, the leg structure being arranged so as to be capable of engaging said arm structure, thereby causing said locking engagement and disengagement.

3. Subsea docking unit according to claim 1, wherein the said arm structures are arranged so as to be pivoted in a plane substantially parallel with a longitudinal axis of a generally elongated docking unit.

4. Subsea docking unit according to claim 1, wherein some selected or most of the external surfaces, preferably those for frictional contact with a docking station are coated with Xylan®.

5. Subsea docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, wherein the actuator means comprises a set of legs extending first outwardly from a centre cross and subsequently bent to follow a peripheral surface of said docking unit.

6. Subsea docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, wherein said actuator means is a tripod and said arm structure comprises a set of three three-armed structure, for allowing interactions of each leg of the tripod with at least one arm of each three-armed structure.

7. Subsea docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, wherein the arm structure is provided with a protruding detail for providing a stopping function when the arm is in sliding contact with an external surface also having a protrusion.

8. Subsea docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, comprising a locking mechanism having a tripod whose three legs are designed to engage and push a set of three structures into a locked position within a recess or niche of said arm retaining detail, whereby said subsea docking unit is locked to the docking station.

9. Subsea docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, comprising an emergency release mechanism in the form of a set of bars, at least a first bar on a first side of one of the tripod legs and a second bar on the opposite side of the same one of the tripod legs, in order normally prevent a rotary movement of the tripod in relation to the docking unit, the stopping bars being mechanically designed and connected so as to be breakable and removable by a typical manipulator of a remote operated vehicle (ROV).

10. A subsea docking station for lockingly engaging and disengaging a docking unit, said docking station comprising:

a main body defining a substantially internal volume for accommodating a docking unit, said main body including an electromechanical connector for connection to a corresponding connector on a docking unit, and an arm receiving and retaining detail in the form of a niche or recess defining an opening towards an inner volume, said opening having a smallest width somewhat smaller than a widest width of an inner volume defined by said the niche or recess.

11. A subsea docking station according to claim 10, comprising a set of arm receiving and retaining details evenly distributed around a peripheral surface or contour of said docking station.

12. A subsea docking station according to claim 10, comprising a set of arm receiving and retaining details equally distributed along a periphery of the docking station as seen from a longitudinal centre axis of said docking station.

13. A subsea docking station according to claim 10, wherein said arm receiving and retaining detail is an integral part of a locking brim of the docking station.

14. A subsea docking station according to claim 13, wherein said arm receiving and retaining detail is arranged near an edge portion of a said locking brim 6, and said locking brim is aligned substantially along a peripheral surface contour of the docking station.

15. A subsea docking station according to claim 10, wherein said arm receiving and retaining detail comprises a niche or recess having an internal protrusion on an inside surface for stopping against a corresponding protruding arm detail of an arm structure of the subsea docking unit for preventing or limiting a sliding action of said three-armed structure against a surface of the arm receiving and retaining detail when the docking unit is locked in the docking station.

16. Subsea docking station according to claim 10, wherein some selected or most of the external surfaces, preferably those for frictional contact with a docking unit are coated with Xylan®.

17. A subsea multiphase flow meter including a docking unit including an electronic module for being removably connected to a subsea docking station, said docking unit comprising:

a canister containing electronics to be connected to a subsea docking station, and a selectively, engageable locking device for locking the docking unit to the subsea docking station, wherein the locking device comprises one or more arm structures adapted for being pivotally mounted into a corresponding arm holding detail on said subsea docking unit, and an actuator means for moving said arm structure in relation to one or more corresponding arm receiving and retaining details on said docking station, whereby a releasable locking engagement and disengagement of the docking unit and docking station is obtained, comprising a funnel shaped docking station, said docking unit being adapted to be removably attached to the docking station and being selectively engageable locking mechanism for locking said docking unit to said docking station; wherein said locking mechanism comprises an actuator means arranged on said docking unit for moving said arm structure in relation to one or more corresponding arm receiving and retaining details on said docking station, whereby a releasable locking engagement and disengagement of the docking unit and docking station is obtained.

* * * * *